343-700 MS AU 251 EX
4/26/88 OR 4,740,793

United States Patent [19]
Wolfson et al.

[11] Patent Number: 4,740,793
[45] Date of Patent: Apr. 26, 1988

[54] ANTENNA ELEMENTS AND ARRAYS

[75] Inventors: Ronald I. Wolfson, Northridge; William G. Sterns, Canoga Park, both of Calif.

[73] Assignee: ITT Gilfillan, Van Nuys, Calif.

[21] Appl. No.: 920,646

[22] Filed: Oct. 20, 1986

Related U.S. Application Data

[63] Continuation-in-part of Ser. No. 660,176, Oct. 12, 1984.

[51] Int. Cl.[4] ..... H01Q 1/48
[52] U.S. Cl. ..... 343/700 MS; 343/829; 343/830
[58] Field of Search ..... 343/700 MS, 829, 830

[56] References Cited

U.S. PATENT DOCUMENTS 4,162,499 7/1979 Jones, Jr. et al. ..... 343/700 MS
4,242,685 12/1980 Sanford ..... 343/700 MS
4,415,900 11/1983 Kaloi ..... 343/700 MS
4,554,549 11/1985 Fassett et al. ..... 343/700 MS
4,623,893 11/1986 Sabban ..... 343/700 MS
4,651,159 3/1987 Ness ..... 343/700 MS
4,660,047 4/1987 Wolfson et al. ..... 343/700 MS

*Primary Examiner*—William L. Sikes
*Assistant Examiner*—Doris J. Johnson
*Attorney, Agent, or Firm*—Robert A. Walsh; Thomas N. Twomey; Mary C. Werner

[57] ABSTRACT

An antenna element including a microstrip radiating element having a microstrip feed line and a ground plane on opposite sides of a substrate, with at least one of a plurality as resonators on the same side of the substrate as the microstrip feed line, and a dipole radiator having an increased bandwidth and insulated from the feed line and from the plurality of resonators.

10 Claims, 9 Drawing Sheets

FIG. 16
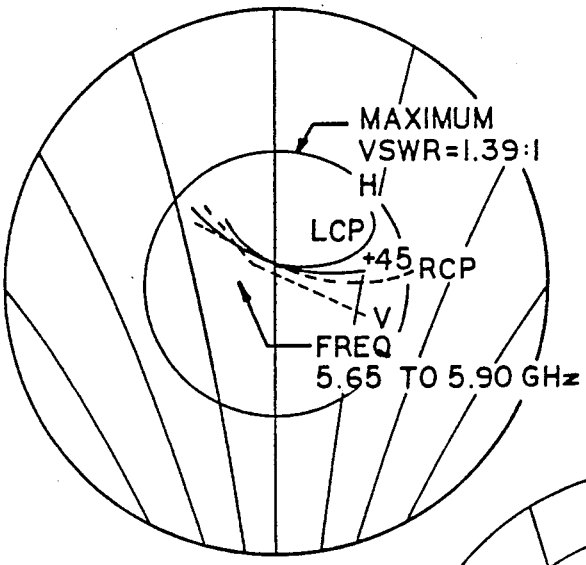
FIG. 17
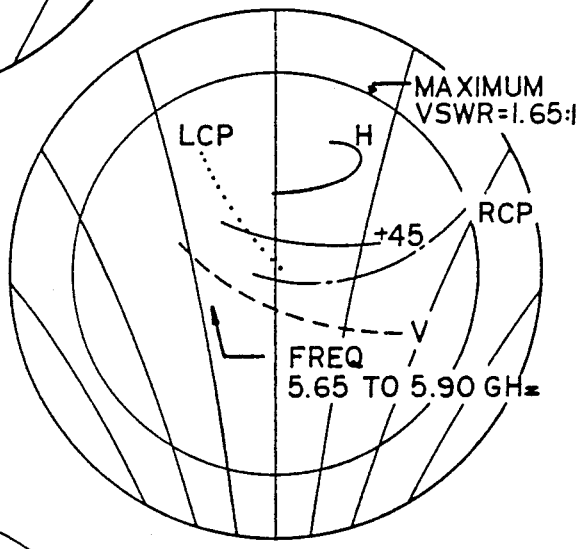
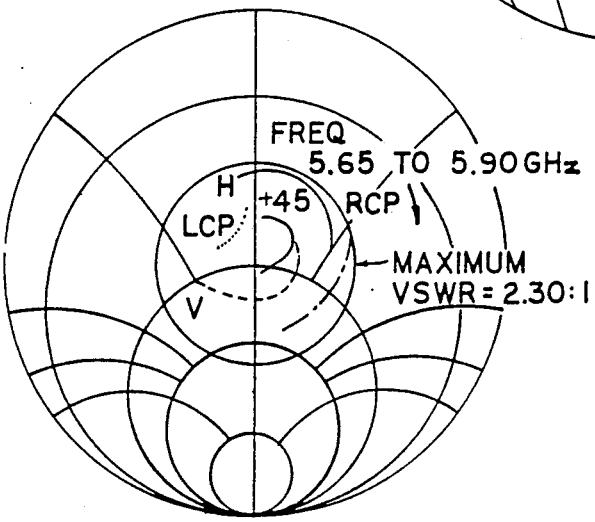
FIG. 18

ANTENNA ELEMENTS AND ARRAYS

This application is a continuation-in-part application of my now co-pending U.S. patent application having Ser. No. 660,176 and filed on Oct. 12, 1984.

BACKGROUND OF THE INVENTION

1. Field of the Invention

This invention relates generally to a means for establishing the propagation of electromagnetic energy, and more particularly to an antenna element.

2. Prior Art Statement

Electromagnetically coupled microstrip dipoles are disclosed in a paper of the same title published in IEEE Transactions on Antennas and Propagation, Vol. AP-29, No. 1, January 1981 and written by H. George Oltman and Donald A. Huebner. Overlapping disclosures exist in this paper and in Oltman, U.S. Pat. No. 4,054,874 issued Oct. 18, 1977.

The references cited in the preceding paragraph disclose a microstrip feed line electromagnetically coupled to a dipole. In FIG. 26 of Oltman, U.S. Pat. No. 4,054,874, dipoles 101 and 103 are illustrated spatially in quadrature.

A problem that exists is that prior art antenna elements have relatively small bandwidths.

A paper was published describing the parent application now U.S. Pat. No. 4,660,047 in June, 1984. The paper was printed in "Antennas and Propagation", Volume II, IEEE Antennas and Propagation Society and was entitled "A High-Performance Microstrip, Dual-Polarized Radiating Element" by R. I. Wolfson and W. G. Sterns, IEEE/AP-S International Symposium, Boston, Massachusetts, June, 1984. (Copyright 1984 by the Institute of Electrical and Electronic Engineers, Inc.).

SUMMARY OF THE PRESENT INVENTION

It is therefore an object of the present invention to provide an improved microstrip radiating element having a plurality of resonators which efficiently couple RF energy from a microstrip or other feed line to a conductive dipole radiator.

It is a further object to provide an improved microstrip radiating element which significantly increases the bandwidth of the conductive dipole radiator.

Briefly, a preferred embodiment of the present invention includes an antenna element having a microstrip radiating element which exhibits an increase in the bandwidth of the conductive dipole radiator by the addition of at least one resonator or resonator circuit or auxiliary resonator circuit located between the microstrip feed line and the conductive dipole radiator. When the loaded Q of the auxiliary resonators are made equal to the loaded Q of the conductive dipole radiator and the proper valves of coupling are selected, a multiple-tuned response is obtained.

In an alternative embodiment, an antenna element having a cross-dipole radiating element exhibits an increase in the bandwidth of the cross-dipole radiator by the addition of at least two resonators between respective microstrip feed lines and the cross-dipole radiator which is inserted in an (8×8) element array.

An advantage of the microstrip radiating element of the present invention is that a plurality of resonators efficiently coupled RF energy from a microstrip or other feed line to a conductive dipole radiator.

Another advantage is that the microstrip radiating element significantly increases the bandwidth of the conductive dipole radiator.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

In the accompanying drawings which illustrate exemplary embodiments of the present invention:

FIG. 16 is the input admittance of a vertical column of eight radiators at 0° azimuth scan (8×8 elements of the array of FIG. 13);

FIG. 17 is the input admittance of a vertical column of eight radiators at 20.7° azimuth scan (8×8 elements of the array of FIG. 13);

FIG. 18 is the input admittance of a vertical column of eight radiators at 45° azimuth scan (8×8 elements of the array of FIG. 13);

DESCRIPTION OF THE PREFERRED EMBODIMENTS

Figure 1:
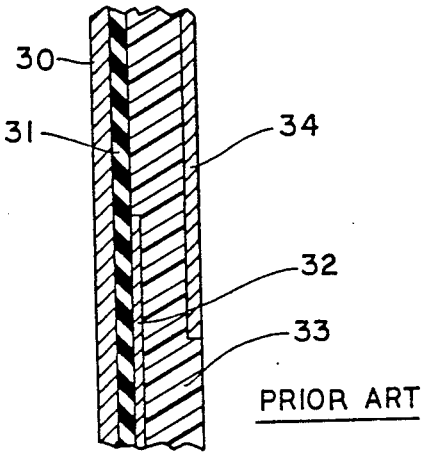
FIG. 1 is a vertical sectional view through a length of microstrip with a conventional antenna element associated therewith taken on the line 1—1 shown in FIG. 2.

In FIG. 1, a conventional structure is shown including a microstrip conductor providing a ground plane is shown at 30 having a conventional substrate 31 bonded thereto. A microstrip feed line 32 is bonded to a dielectric substrate 31. A conventional closed cell foam dielectric spacer 33 is bonded to and over substrate 31 and to and over microstrip feed line 32. A dipole radiator 34 is bonded to spacer 33.

Figure 2:
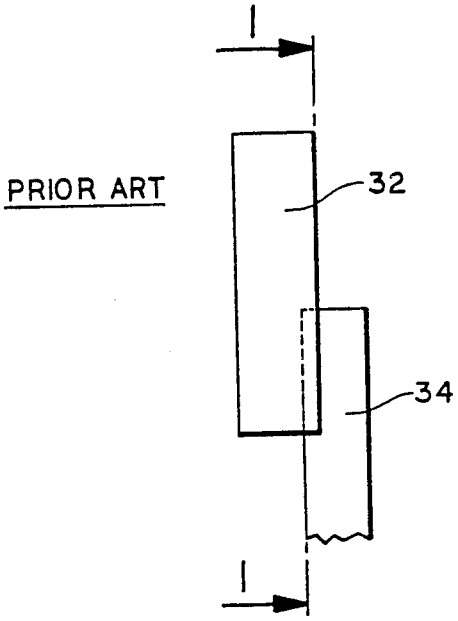
FIG. 2 is a right side elevational view of only microstrip feed line and dipole portions shown in FIG. 1.

FIG. 2 does not show conductor 30, substrate 31 or spacer 33, but does show dipole 34 and microstrip feed line 32 and their relative positions.

Figure 3:
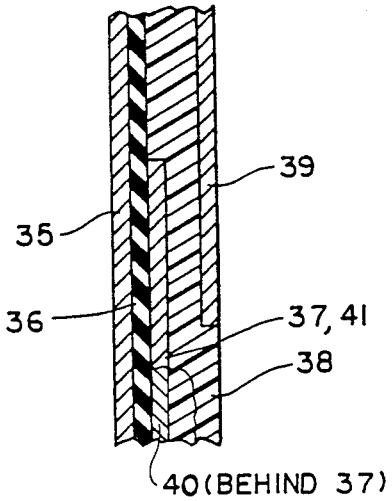
FIG. 3 is a vertical sectional view through a length of microstrip with an antenna element of the present invention associated therewith taken on the line 3—3 shown in FIG. 4 and FIG. 4A.

In FIG. 3, one embodiment of the present invention is shown including a microstrip conductor providing a ground plane at 35. A dielectric substrate is shown at 36 with a first of a plurality of "N" resonators shown at 37. Two of the plurality of "N" resonators are shown more clearly in FIG. 4A. A dielectric spacer is shown at 38 and a conductive dipole radiator is shown at 39.

Figure 4:
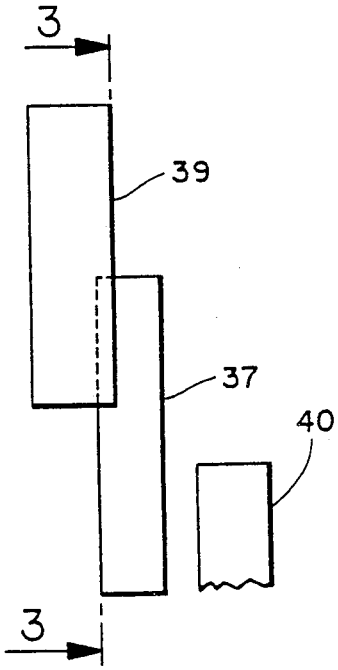
FIG. 4 is a right side elevational view of only microstrip feed line, dipole and resonator portions shown in FIG. 3.

Dipole 39 is shown in FIG. 4 with a microstrip feed line 40 and resonator 37.

Substrate 36 is bonded to conductor 35, spacer 38, resonators 37 and 41 and microstrip feed line 40. Dipole 39 is bonded to spacer 38.

Dipole 39, resonators 37 and 41 and microstrip feed line 40 may all be thin in comparison to their widths and lengths, as shown. Preferably, resonators 37 and 41 each have a loaded Q to match the Q of dipole 39.

Figure 4A:
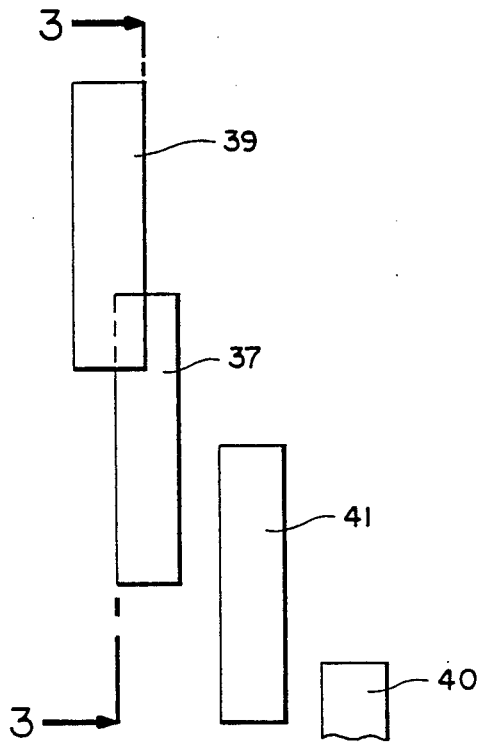
FIG. 4A is a right side elevational view of a plurality of resonator portions and of microstrip feed line and dipole portions shown in FIG. 3.

Microstrip feed line 40 and resonators 37 and 41 may or may not have the same thickness and/or width. Each have surfaces which lie wholly in about the same planes between substrate 36 and spacer 38. FIG. 4A shows the single resonator 37 of FIG. 4 replaced by two of the plurality of resonators 37, 41 in order to realize a multiple-tuned response which further increases the bandwidth of the radiator 39.

Figure 5:
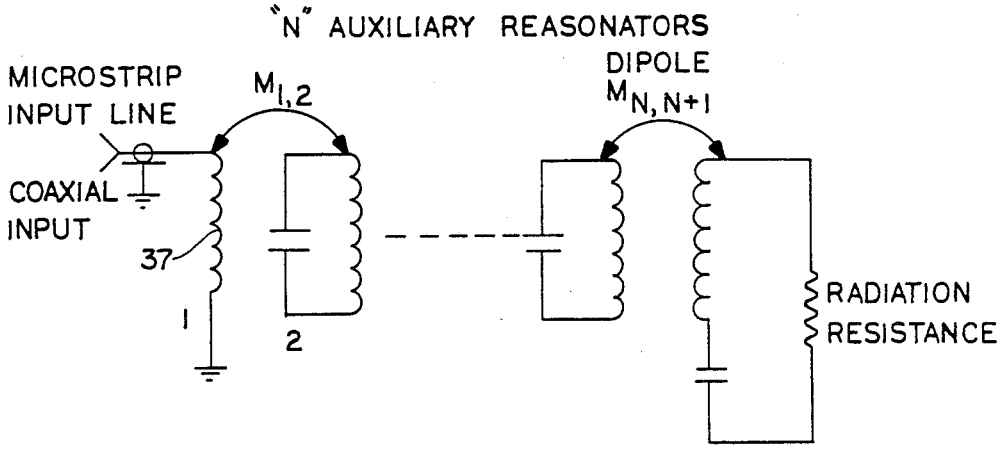
FIG. 5 is a schematic diagram of the equvalent circuit of the electromagnetically coupled dipole with auxiliary resonators of the present invention as shown in FIGS. 3, 4 and 4A.

As shown in FIG. 5, one of the plurality of resonators 37 is fed from a coaxial cable and includes "N" auxiliary resonators and the mutual inductance therebetween.

Figure 8:
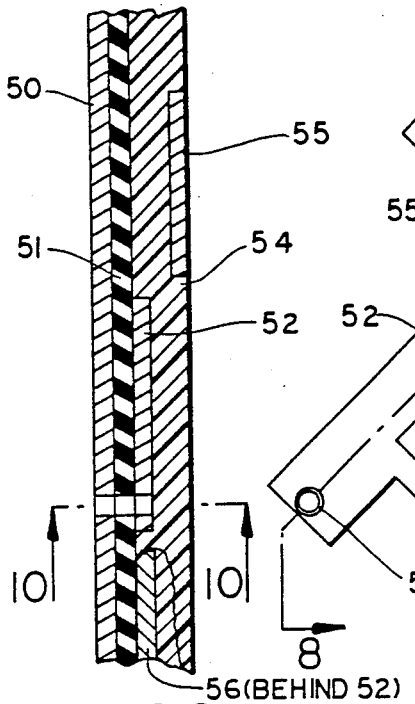
FIG. 8 is a vertical sectional view through a length of microstrip with alternate antenna elements of the present invention associated therewith taken on the line 8—8 shown in FIG. 9.
Figure 9:
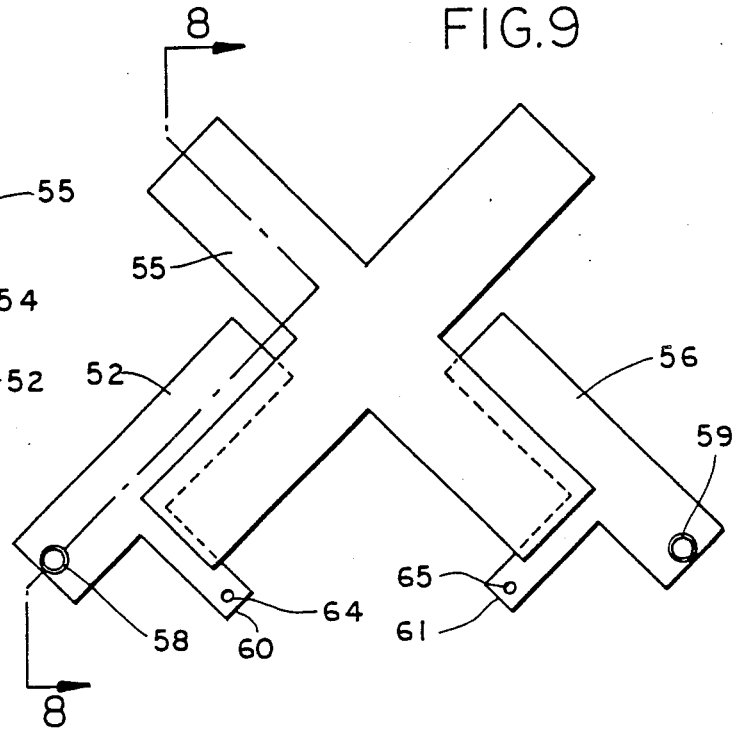
FIG. 9 is a right side elevational of only dipole and resonator portions shown in FIG. 8.
Figure 11:
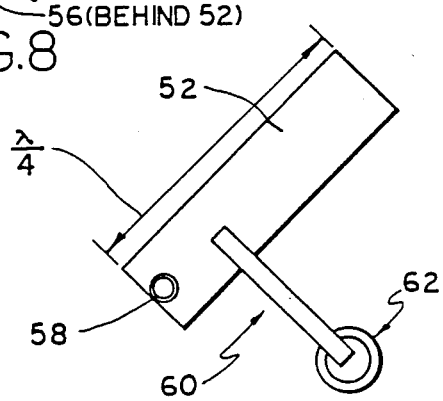
FIG. 11 is a side elevational view of the same type of resonators shown in FIG. 9 illustrating ground locations thereon and points thereon at which they are fed.
Figure 11:
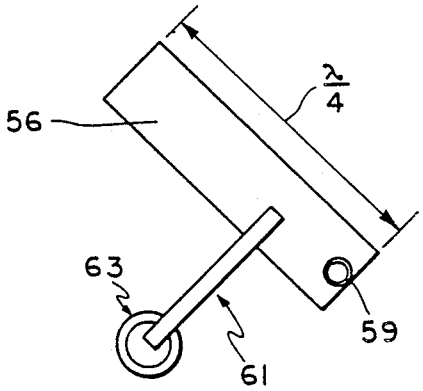
Figure 9A:
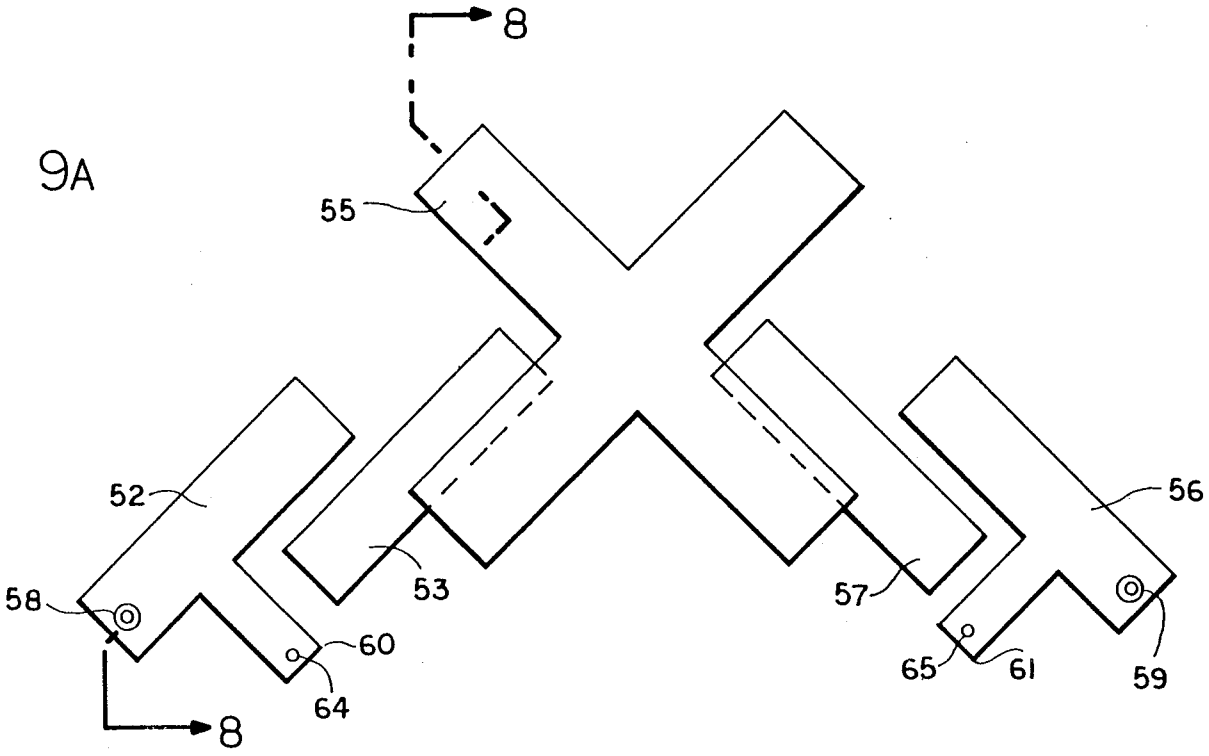
FIG. 9A is a right side elevational of only dipole and a plurality of resonator portions shown in FIG. 8.

In FIGS. 8, 9 and 9A, an alternative embodiment of the present invention is shown including a microstrip having a conductive layer 50, a substrate 51, two of a plurality of "N" resonators 52, 53, 56 and 57 of which resonators 52 and 56 are shown in FIGS. 8 and 9, a dielectric spacer 54 and a cross-dipole radiator 55. The remaining two of the plurality of resonators 53 and 57 are also provided as shown in FIG. 9A.

Figure 10:
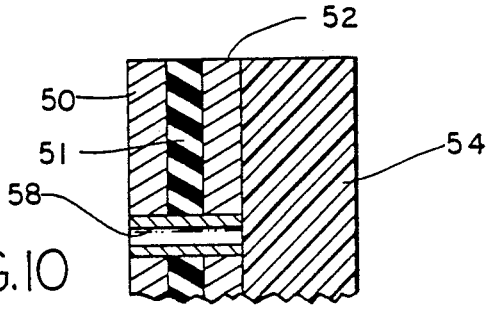
FIG. 10 is an enlarged transverse sectional view taken on the line 10—10 of the structure shown in FIG. 8.

Resonators 52, 53, 56 and 57 are approximately one-quarter wavelength long. A radio frequency (RF) ground is supplied at 58 and 59 of the respective ends of the resonators 52 and 56. Each RF ground is provided with two identical plated through holes, one of which is shown at the radio frequency ground 58 in FIG. 10. The resonators 52 and 56 are fed near the RF grounds 58 and 59 by microstrip feed lines 60 and 61 respectively. The microstrip feed lines 60, 61 are fed by coaxial cables 62 and 63. Within the microstrip feed lines 60, 61 are located respectively one of a plurality of two registering holes 64, 65 for alignment purposes.

FIG. 9A shows the pair of resonators 52, 56 of FIG. 9 replaced by a plurality of four resonators 52, 53, 56 and 57 in order to realize a multiple-tuned response which further increases the bandwidth of the cross dipole radiator 55.

The voltages in the coaxial cables 62, 63 are equal in amplitude. When in phase, vertical polarization is radiated but when the voltages are out of phase, horizontal polarization radiates. With a relative phase of ±90°, circular polarization is achieved.

SUMMARY

Microstrip radiating elements generally have limited application in scanning array antennas because of poor impedance characteristics over operating frequency bands that exceed a few percent, or scan angles wider than about ±20 degrees. Furthermore, if the radiators are dual-polarized elements, polarization purity is often less than 18 dB due to unwanted cross-coupling between the individual radiators or their feed lines.

The following describes a technique for significantly improving the match of a microstrip radiating element over moderate bandwidths, and describes the performance of a dual-polarized C-band radiator in an 8×8 element array. A class of printed circuit radiators consisting of a dipole that is electromagnetically coupled (EMC) to a microstrip feed line has been recently described in the prior art, as aforesaid. The main advantage of this approach over more conventional designs is that the dipole can be located above the ground plane to optimize bandwidth and efficiency, while simultaneously reducing parasitic radiation from the microstrip feed line. The basic prior art EMC dipole configuration is illustrated in FIGS. 1 and 2. Although bandwidth of this circuit is readily optimized in practice, it is still restricted to the single-tuned response characteristic of a dipole.

Figure 6:
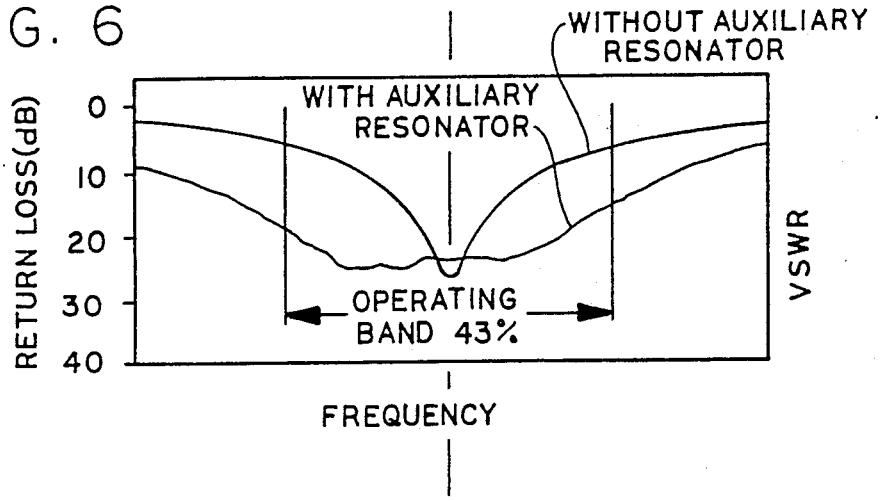
FIG. 6 is a graph of input match versus frequency of the invention shown in FIGS. 3 and 4 and shows the improvement over the prior art.
Figure 12:
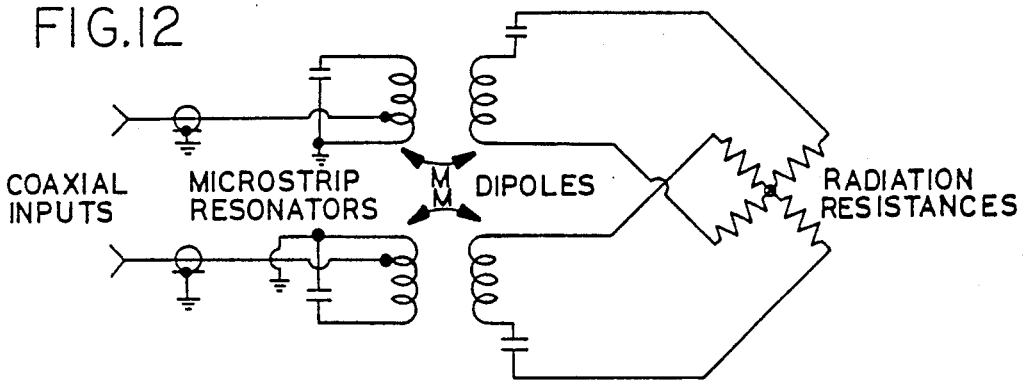
FIG. 12 is a schematic diagram of the equivalent circuit of the radiator and resonators of FIGS. 9 and 11.
Figure 7:
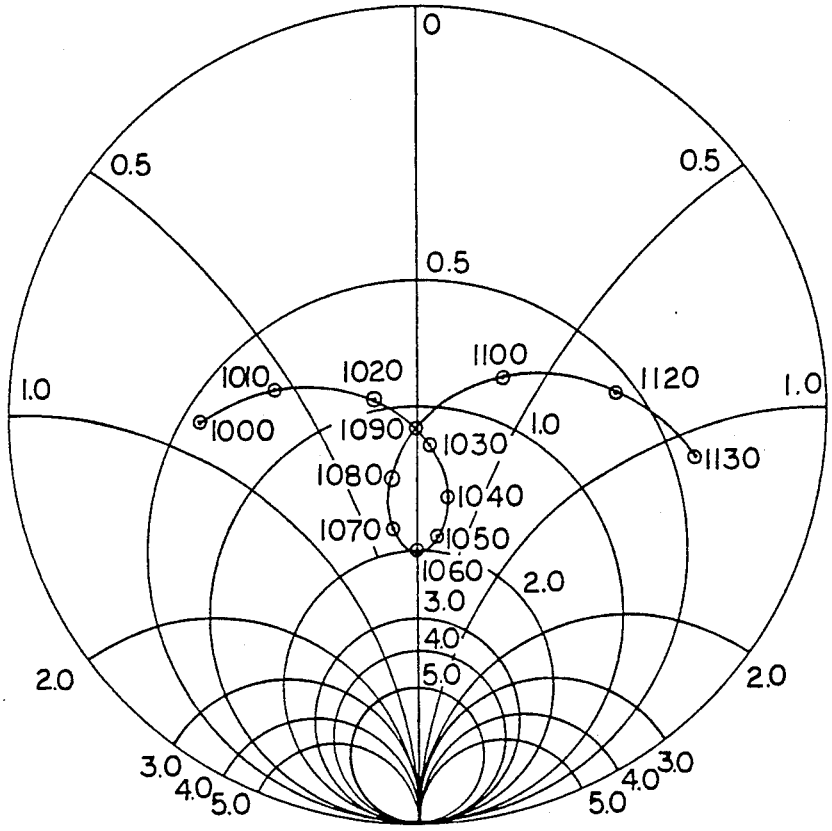
FIG. 7 is a graph of the input admittance of a radiator designed in accordance with the present invention.

In accordance with the present invention, a significant improvement in bandwidth can be realized by the addition of a plurality of resonators 37 and 41 or 52 and 56 and/or 53 and 57 or the resonant circuits or auxiliary resonant circuits located between the microstrip feed line 40 and dipole radiator 39, as shown in Figs, 3, 4 and 4A or between the microstrip feed lines 60, 61 and the dipole radiator 55 as shown in FIGS. 8, 9 and 9A. If the loaded Q of the auxiliary resonators 37 and 41 or 52 and 56 and/or 53 and 57 are made equal to that of the dipole 39 or 55, and the proper values of coupling are selected, a multiple-tuned response is obtained. FIG. 6 shows the double-tuned response for a single resonator 37. For an input voltage standing wave ratio (VSWR) of 1.5:1, the addition of the auxiliary resonator 37 increases the bandwidth of the conductive dipole radiator 39 from about 1.5 to 5.5 percent.

The cross-dipole radiator 55 shown in FIGS. 8–12 covers the frequency range of (5.65 to 5.90) GHz. For this application, best performance is realized with a variation of the auxiliary resonators 52, 56 and/or 53, 57. One end is RF grounded at 58 and 59 (FIGS. 8–12), and the microstrip feed lines 60, 61 (FIGS. 9 and 9A) are direct taps rather than coupled electromagnetically. This configuration, which has the equivalent circuit shown in FIG. 12, leads to a geometry whereby unwanted cross-coupling between the closely located feed lines 60, 61 and auxiliary resonators 52, 56 and/or 53, 57 is kept to a minimum.

The construction procedure includes the following steps: determine the length and width of the dipole 39 or 55; find the length, width, and tap point of the auxiliary resonators 37 and 41 and/or 52, 56 and/or 53, 57; and then adjust the location and height of the dipole 39 or 55 over the resonator 37 and 41 and/or 52, 56 and/or 53, 57 for best VSWR and radiation characteristics. As the dipoles in 55 are orthogonal, and thus electrically independent, this optimization process can also be accomplished with a single dipole radiator 39 (FIGS. 3 and 4).

Figure 13:
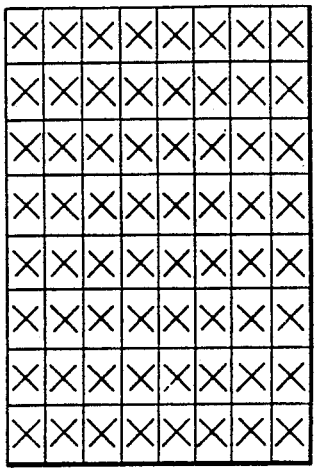
FIG. 13 is a front elevational view of an array of cross-dipole radiators.

After the construction of the isolated cross-dipole radiator 55 (FIGS. 9 and 9A) has been completed, an (8×8) element array can be built so that the effects of mutual coupling can be observed, and final modifications made to optimize the radiator 39 or 55 in the array environment. Such an array is illustrated in FIG. 13.

Figure 14:
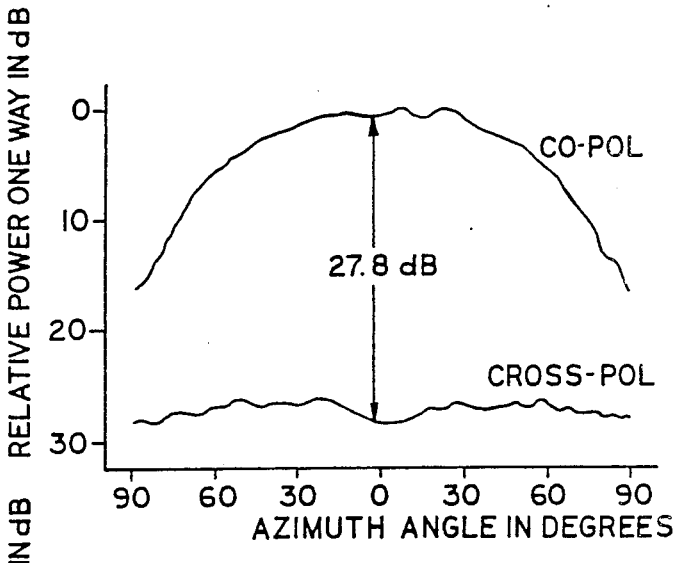
FIG. 14 is an active element aximuth pattern at 5.775 GHz for horizontal polarization (in FIG. 13)
Figure 15:
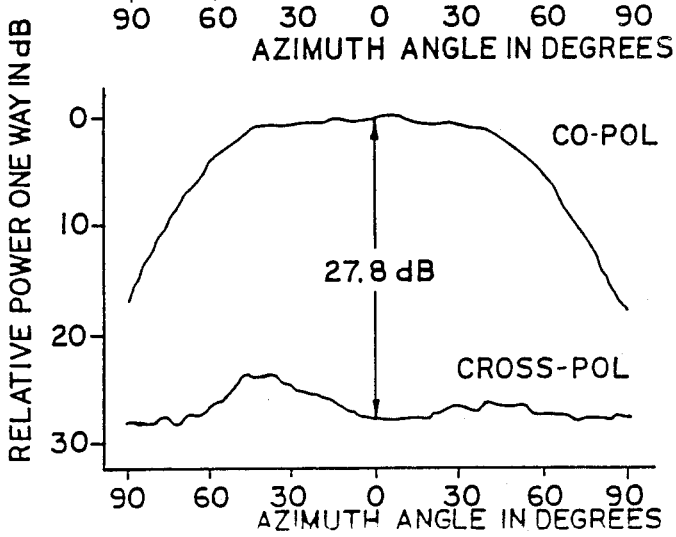
FIG. 15 is an active element azimuth pattern at 5.775 GHz for vertical polarization (in FIG. 13)

The active element azimuth patterns for horizontal and vertical polarization are shown in FIGS. 14 and 15. Coverage is excellent out to ±45 degrees, the aximuth scan limits for which this radiator 39 or 55 was developed.

Input admittance (reference plane at resonator input) over the operating frequency band of a vertical column of eight radiators is shown in FIGS. 16–18 for five polarizations: horizontal, vertical, +45 degrees, righthand circular and lefthand circular. Azimuth scan angle is 0 degrees, 20.7 degrees, and 45 degrees, respectively. The VSWR of 2.3:1 at 45 degrees scan could be improved at the expense of the VSWR at closer-in scan angles; however, this may not be desirable for the intended application.

Figure 19:
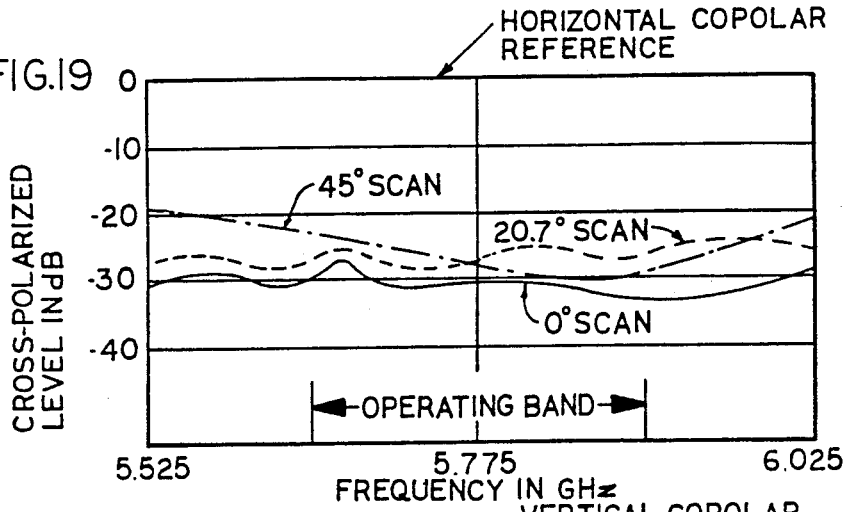
FIG. 19 is a graph showing horizontal polarization purity regarding the array of FIG. 13.
Figure 20:
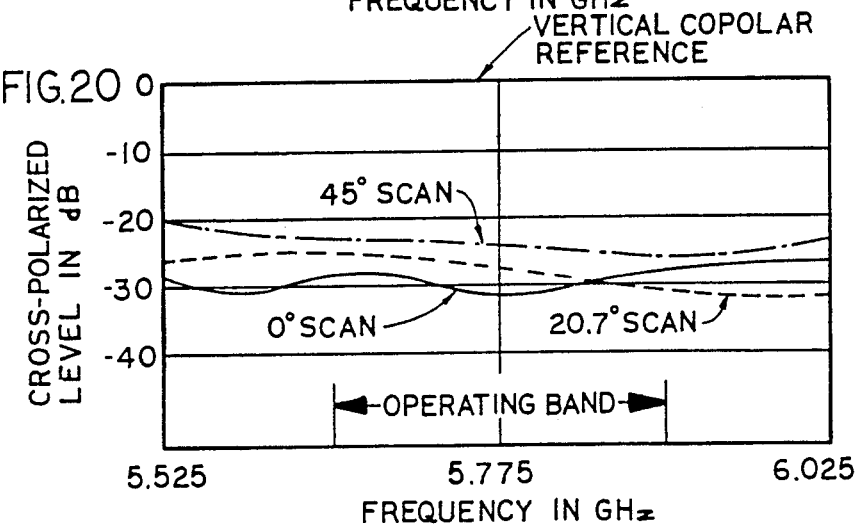
FIG. 20 is a graph showing vertical polarization purity regarding the array of FIG. 13.
Figure 21:
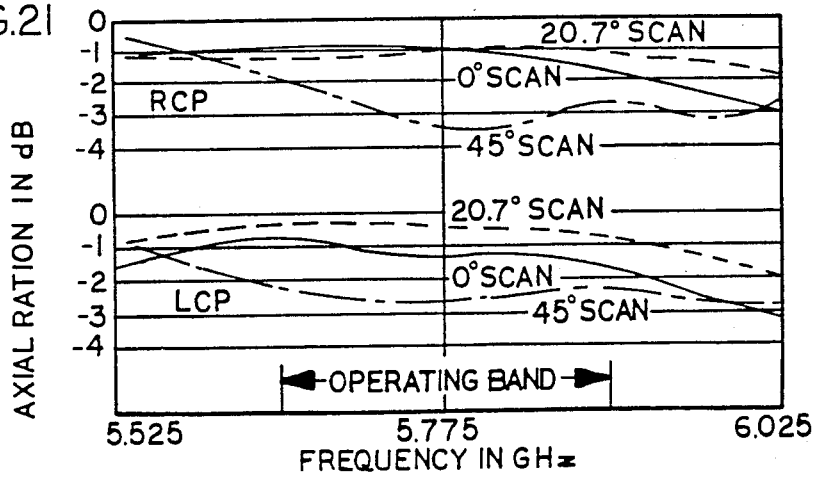
FIG. 21 is a graph showing the circular polarization axial ratio.

The polarization characteristics of the 8×8 element array are shown in FIGS. 19, 20 and 21 for horizontal, vertical and circular polarization, respectively.

CONCLUSIONS

A technique for significantly improving bandwidth of an EMC microstrip radiator 39 by exciting it with a plurality of auxiliary resonators 37 and 41 has been disclosed. Data on a C-band cross-dipole radiator 55 measured in an 8×8 element array has also been disclosed.

An input match better than 2.30:1 can be obtained for all polarizations over a 4.3 percent bandwidth and ±45 degrees azimuth scan, and 1.65:1 over ±20.7 degrees azimuth scan.

Polarization purity of about 25 dB can be obtained for linear polarization over the frequency operating band and ±45 degrees azimuth scan. For circular polarization, axial ratio of about 1 dB can be achieved for ±20.7 degrees aximuth scan, with about 3 dB at ±45 degrees azimuth scan.

The performance disclosed herein thus represents a substantial improvement over that reported in the prior art for similar microstrip radiators.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. A radiating element comprising, in combination:

a microstrip including a ground plane first conductor;

a dielectric microstrip substrate having first and second opposite sides, said first substrate side being bonded to said ground plane first conductor;

a plurality of conductive resonators resident intermediate a microstrip feed line and a conductive dipole, said microstrip feed line in electrical communication with said plurality of conductive resonators, said plurality of conductive resonators and said microstrip feed line being bonded to said second substrate side;

a dielectric spacer having first and second opposite sides, said first spacer side being bonded to and over said second substrate side, to and over said plurality of conductive resonators and to and over said microstrip feed line; said conductive dipole being bonded to said dielectric spacer second side and spaced from said plurality of conductive resonators for optimizing bandwidth and efficiency of the radiating element.

2. A radiating element comprising, in combination:

a microstrip including a ground plane first conductor;

a dielectric microstrip substrate having first and second opposite sides, said first substrate side being bonded to said ground plane first conductor;

a plurality of conductive resonators resident intermediate a plurality of microstrip feed lines and a conductive dipole, said microstrip feed lines in electrical contact with said plurality of conductive resonators, said plurality of conductive resonators and said microstrip feed lines being bonded to said second substrate side;

a dielectric spacer having first and second opposite sides, said first spacer side being bonded to and over said second substrate side, to and over said plurality of conductive resonators and to and over said microstrip feed lines; said conductive dipole being bonded to said dielectric spacer second side and spaced from said plurality of conductive resonators for optimizing bandwidth and efficiency of the radiating element;

a plurality of coaxial cables each having an inner and an outer conductor for providing an input to said radiating element;

means for grounding a first end of a first of said conductive resonators to said ground plane first conductor, and means for connecting said coaxial cable inner conductor to said first of said plurality of conductive resonators at a distance near said grounded first end, said first of said plurality of conductive resonators being a quarter wavelength resonator.

3. The invention as defined in claim 2, wherein said first of said plurality of conductive resonators includes a tap point such that the loaded Q of said first of said plurality of conductive resonators is equal to the Q of said conductive dipole.

4. The invention as defined in claim 2, wherein said ground plane first conductor, said dielectric microstrip substrate and said first of said plurality of conductive resonators include a plurality of three respective registering holes at said first end of said first of said plurality of conductive resonators, and conductive means extending through all three of said plurality of registering holes electrically connecting said ground plane first conductor and said first of said plurality of conductive resonators.

5. The invention as defined in claim 2 further including a means for connecting each of said coaxial cable inner conductor to said first of said plurality of conductive resonators at a distance from said first end of said first of said plurality of conductive resonators.

6. The invention as defined in claim 2, wherein said plurality of conductive resonators and microstrip feed lines are each thin and long in comparison to the widths of said plurality of conductive resonators and microstrip feed lines.

7. A radiating element comprising:

a microstrip including a ground plane first conductor;

a dielectric microstrip substrate having first and second opposite sides, said first substrate side being bonded to said first conductor;

a conductive resonator resident intermediate a microstrip feed line and a conductive dipole, said microstrip feed line spaced from said conductive resonator, said conductive resonator and said microstrip feed line being bonded to said second substrate side;

a dielectric spacer having first and second opposite sides, said first spacer side being bonded to and over said second substrate side, to and over said conductive resonator and to and over said microstrip feed line; said conductive dipole being bonded to said dielectric spacer second side and spaced from said conductive resonator for optimizing bandwidth and efficiency of the radiating element;

a coaxial cable having an inner and an outer conductor for providing an input to said radiating element:

means for grounding a first end of said conductive resonator to said first conductor: and means for connecting said coaxial cable inner conductor to said conductive resonator at a distance near said grounded first end.

8. The invention as defined in claim 7, wherein said conductive resonator comprises a tap point such that the loaded Q thereof is equal to the Q of said conductive dipole.

9. The invention as defined in claim 7, wherein said first conductor, said dielectric microstrip substrate and said conductive resonator have three respective registering holes at said first end of said conductive resonator, and conductive means extending through all three of said registering holes electrically connecting said first conductor and said conductive resonator.

10. The invention as defined in claim 9, wherein said conductive resonator and said microstrip feed line are thin and long in comparison to their widths.

* * * * *